United States Patent [19]

Mochizuki et al.

[11] Patent Number: 5,010,934

[45] Date of Patent: Apr. 30, 1991

[54] SLICER APPARATUS FOR WOODWORK

[75] Inventors: Toshihei Mochizuki; Shigeru Ikeda, both of Shizuoka, Japan

[73] Assignee: Marunaka Tekkosho, Inc., Shizuoka, Japan

[21] Appl. No.: 510,222

[22] Filed: Apr. 17, 1990

[30] Foreign Application Priority Data

Mar. 6, 1990 [JP] Japan ..... 2-54285

[51] Int. Cl.[5] ..... B27L 5/06

[52] U.S. Cl. ..... 144/175; 144/120

[58] Field of Search ..... 144/120, 128, 130, 162 R, 144/175

[56] References Cited

U.S. PATENT DOCUMENTS 3,783,917 1/1974 Mochizuki ..... 144/120
4,252,163 2/1981 Onda et al. ..... 144/130

FOREIGN PATENT DOCUMENTS 2118966 10/1972 Fed. Rep. of Germany ..... 144/120
63-172608 11/1988 Japan .

*Primary Examiner*—W. Donald Bray
*Attorney, Agent, or Firm*—Kanesaka and Takeuchi

[57] ABSTRACT

A woodwork slicer apparatus is disclosed for slicing a thick veneer, which is pressed and advanced by a material feeding belt to a table surface. The material feeding belt, driven by power, is arranged so as to oppose a table, which includes a knife. The relief face of the knife is disposed so as to oppose a rand. There is a space between the relief face and the rand that is substantially the same as the thickness of the veneer to be sliced. Further, a guide, which is fixed by a fixing means so as to be in contact with the rand, is provided. For the above reasons, the veneer to be sliced is prevented from being cracked and is guided into a feeding direction along with the guide.

10 Claims, 5 Drawing Sheets

SLICER APPARATUS FOR WOODWORK

BACKGROUND OF THE INVENTION

1. Field of the Invention

The present invention relates to a slicer apparatus for woodwork, and more particularly to a slicer apparatus suitable specifically for producing thick veneers.

The thick veneers are used as package material, fruit box, fence, flooring, surface lumbers, edge lumbers, or the like, which are attached to laminated lumbers, lumbers with inferior quality, or the like.

2. Description of the Related Art

A conventional slicer apparatus for woodwork has a guide on a side opposite to a relief face of a knife.

Because the space between the knife and the relief face is rather larger than a thickness of a veneer to be sliced, such a problem existed in that a crack may occur in the veneer when the thickness of a veneer to be sliced is approximately 3 mm to 13 mm.

SUMMARY OF THE INVENTION

It is an object of the present invention to provide a slicer apparatus, which prevents the veneer to be sliced from being cracked, and guides the veneer smoothly to a feeding direction.

When veneers are sliced by the slicer apparatus according to this invention, a relief face of a knife is arranged so as to oppose a support member. Since the space between the relief face of the knife and the support member is about the same as the thickness of a veneer to be sliced, the above-mentioned object can be achieved by preventing the sliced veneer from separating from the relief face of the knife.

Further, according to this invention, because a guide is fixed by a fixing means to the support member, the sliced veneer is guided along with the support member and the guide. The above-mentioned object can thus be obtained.

DESCRIPTION OF THE PREFERRED EMBODIMENTS

An embodiment according to the present invention will now be described with reference to the accompanying drawings.

Figure 1:
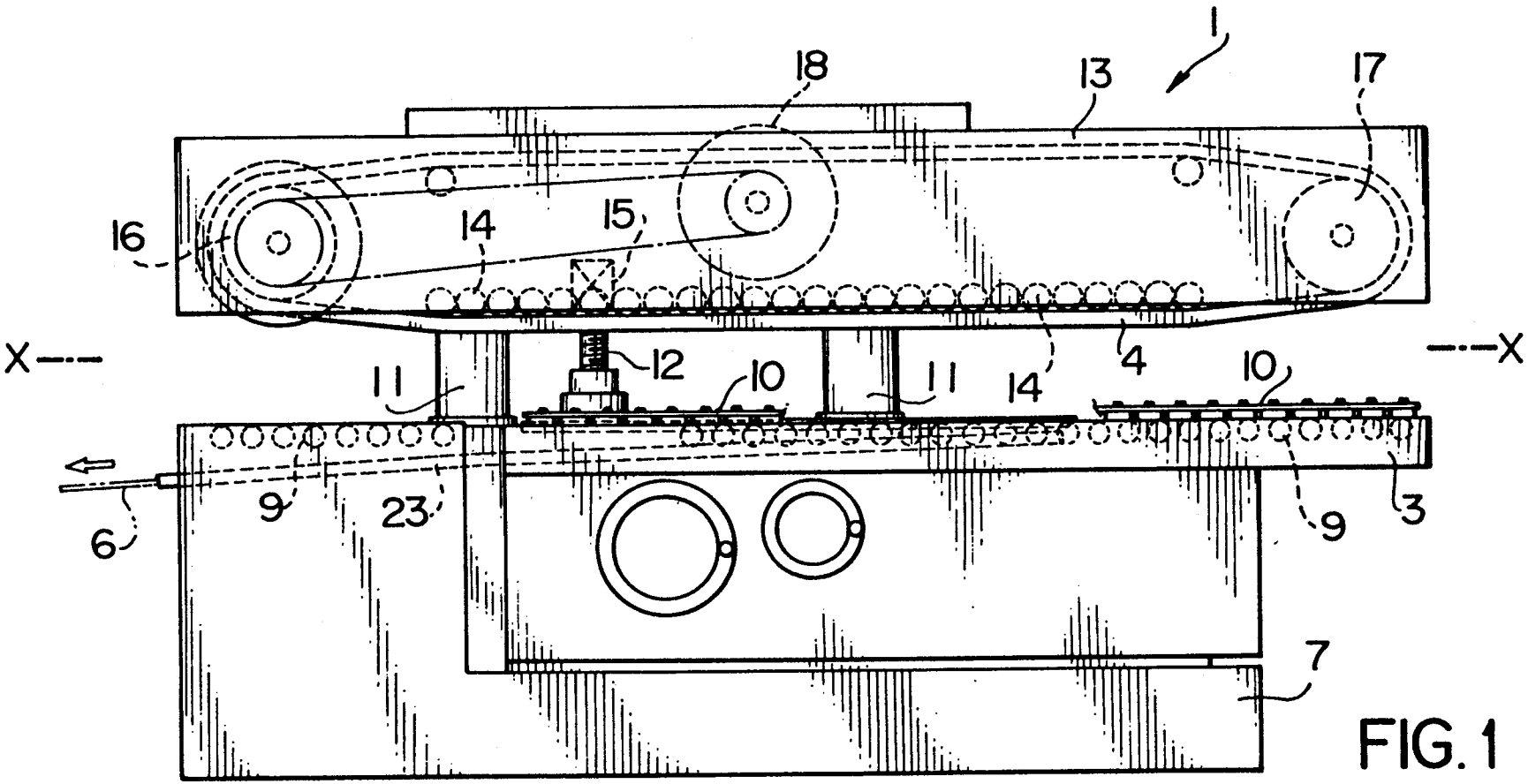
FIG. 1 is a side view showing a slicer apparatus for woodwork of an embodiment according to the present invention.
Figure 2:
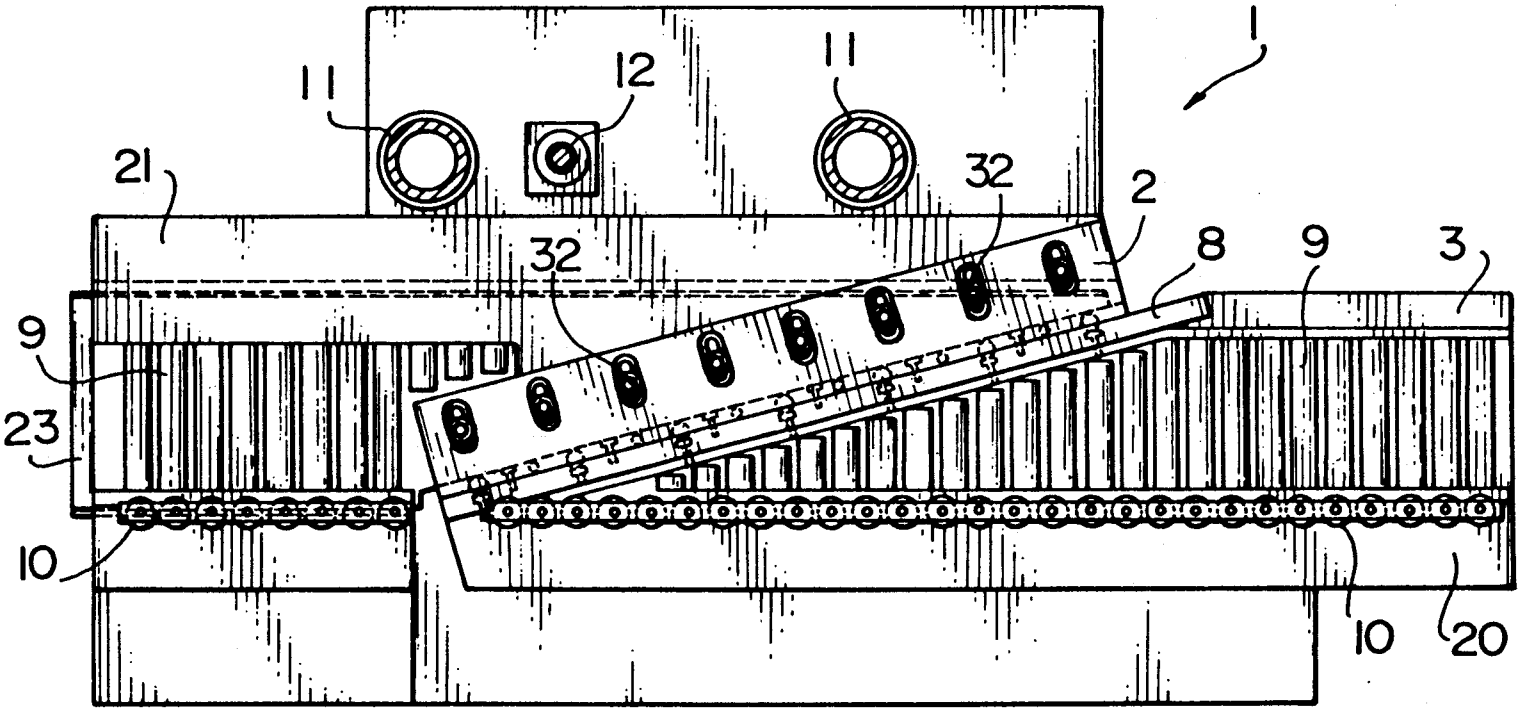
FIG. 2. is a section view taken on line 2—2 of FIG. 1.

As shown in FIGS. 1 and 2, a slicer apparatus for woodwork 1 comprises a table 3 which has a knife 2. The knife 2 is arranged so as to oppose a material feeding belt 4, which is driven by a power device. A material or wood 5 to be sliced is pressed and advanced onto the surface of the table 3 by the material feeding belt 4. Thus, a veneer 6 is sliced. A frame 7 is arranged under the table 3, which bears the knife 2 at the center of the table 3.

The knife 2 has an oblique angle of approximately 80° and a tool angle of about 15° in relation to a feeding material.

The table 3 is provided with a knife piece 8, which is arranged parallel to the knife 2.

The knife piece 8 and the knife 2 are arranged to have a difference in height, which can be set at any thickness required for slicing the veneer 6. (For example, a thickness can be adjusted by fixing a back table 21 and moving a front table 20 up and down.)

Furthermore, expect for locations where the knife 2 and the knife piece 8 are arranged, a number of table rollers 9, which support the back surface of the material is so lined on the feeding surface of the table 3 as to have a common plane. Ruler rollers 10 are arranged longitudinally on one side of the table 3 to form a straight line. The edge of the material 5 faces against the ruler rollers 10.

As shown in FIG.1, an elevator 13 is supported by columns 11, which stand on the frame 7. The elevator 13 moves up and down by a feed screw 12.

Pressure rollers 14 are provided at the back of a feed belt 4 of the elevator 13 so that the center of the pressure rollers 14 corresponds to that of the table rollers 9. The shaft of each pressure roller 14 (not shown) is pushed downward by a spring (not shown) of a known spring cushion. The pressure rollers 14 provide pressure required for the feeding belt 4.

Furthermore, a drive roller 16 is provided at the front of the elevator 13 and a driven roller 17 is provided at the back. Both rollers 16, 17 are supported by the elevator 13. The feed belt 14 is fitted endlessly over the drive roller 16 and the driven roller 17.

Rotation of a speed reduction motor 18 is transmitted to the drive roller 16.

Figure 5:
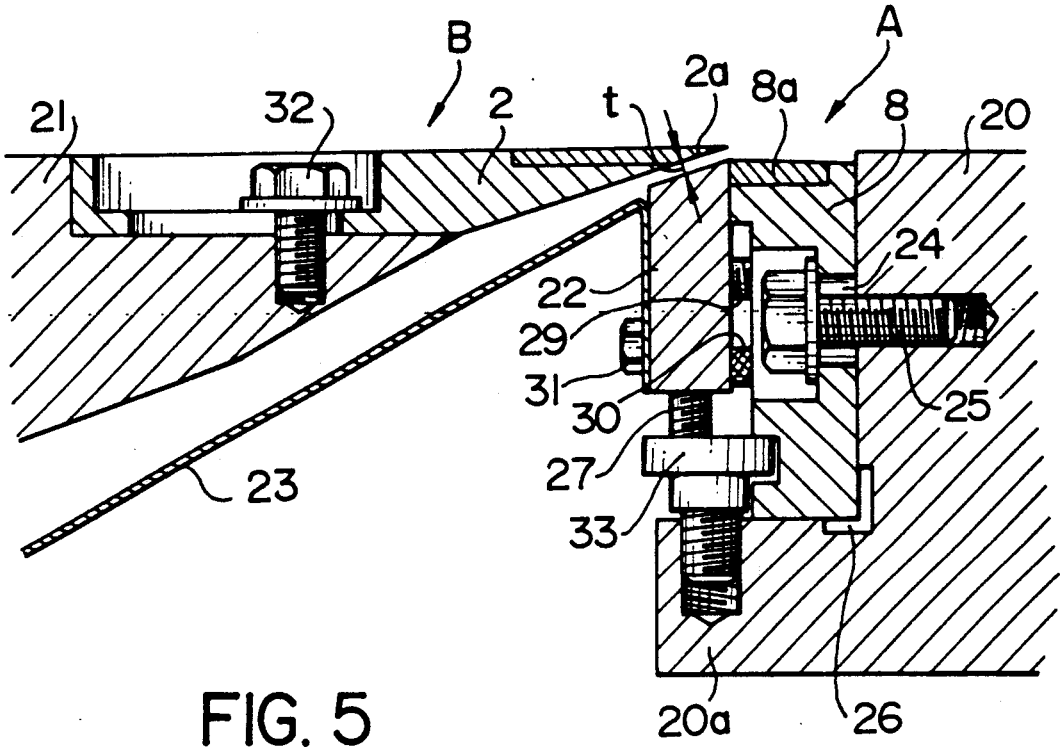
FIG. 5 is a section view taken on line 5—5 of FIG. 4, showing attachment of the knife and the knife piece.
Figure 6:
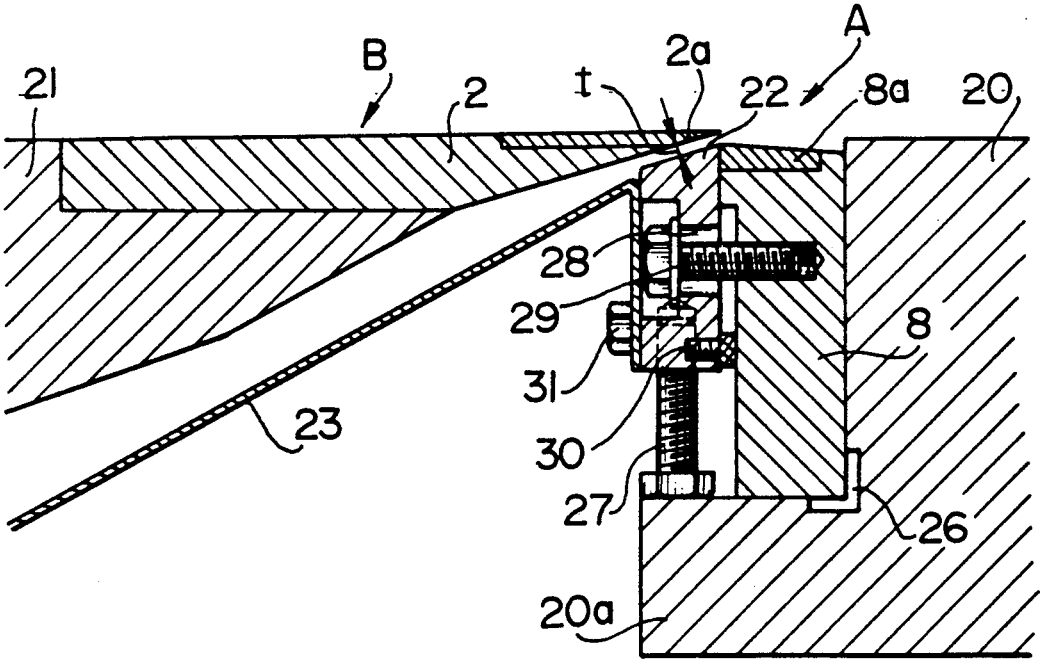
FIG. 6 is a section view taken on line 6—6 of FIG. 4, showing attachment of a support member and a guide.

As shown in FIGS. 5 and 6, the table 3 is provided with a knife piece portion A attached to the front table 20 and a knife piece portion B attached to the back table 21.

The knife piece portion A comprises, for example, the knife piece 8, a support member 22 and a guide 23.

An edge portion 8*a* of the knife piece 8 is formed by such hard materials as high-speed steel or stellite.

The height of knife piece 8 is adjusted by an adjusting screw 33, which is fitted into a female screw arranged in a step portion 20*a* of the front table 20.

The knife piece 8 is fixed, by fixing means, such as a bolt 25, to the front table 20, through an adjusting long hole 24. Numeral 26 indicates a relief groove.

The support member 22 is fixed to an end of the knife piece 8, so as to oppose the relief face 2*a* of the knife 2. A space t between the relief face 2*a* of the knife 2 and the support member 22 is substantially the same thickness t, of the veneer to be sliced. The reason for the substantially equal thickness ($t \approx t'$) is that the tip of the knife 2 is raised a little and warped when the veneer 6 is sliced.

The face of the support member 22, which opposes the relief face 2*a*, may be formed so as to be parallel to the relief face 2*a*. However, it is desirable that an angle formed by the relief face 2*a* and the face of the support member 22 be slightly widened in a direction where the veneer 6 to be sliced is moved. The relief face 2*a* of the knife 2 is the portion where the veneer to be sliced is contacted.

In particular, the height of the support member 22 is adjusted by an adjusting bolt 27, which is fitted into a female screw arranged in the support member 22. The rand 22 is fixed, by a fixing means, such as a bolt 29, to the knife piece 8, through an adjusting long hole 28. Numeral 30 indicates an adjusting screw for adjusting the support member 22 horizontally.

The guide 23 is fixed by fixing means, such as a bolt 31, to the support member 22 through an aperture arranged in the guide 23.

Figure 3:
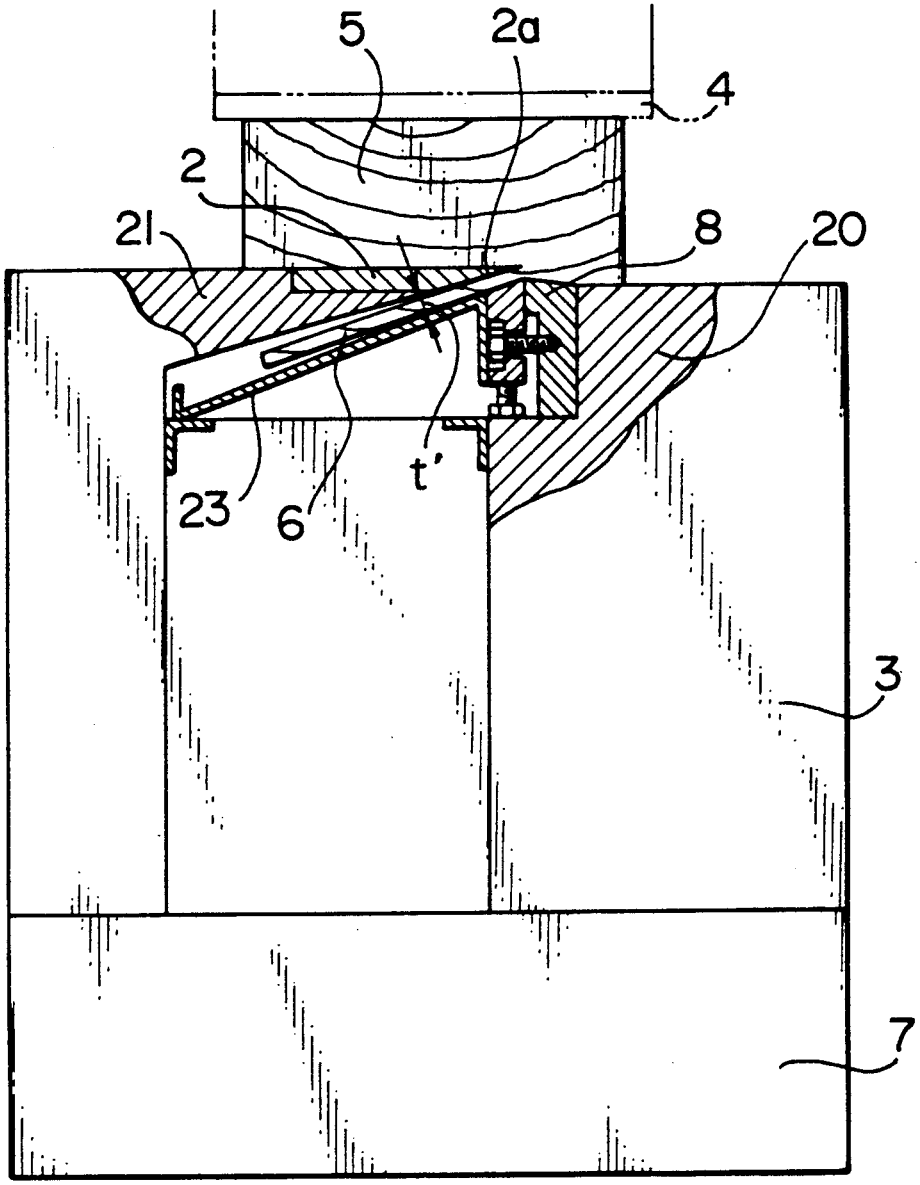
FIG. 3 is a section view illustrating a use condition of the slicer apparatus for woodwork, an elevator being omitted.
Figure 4:
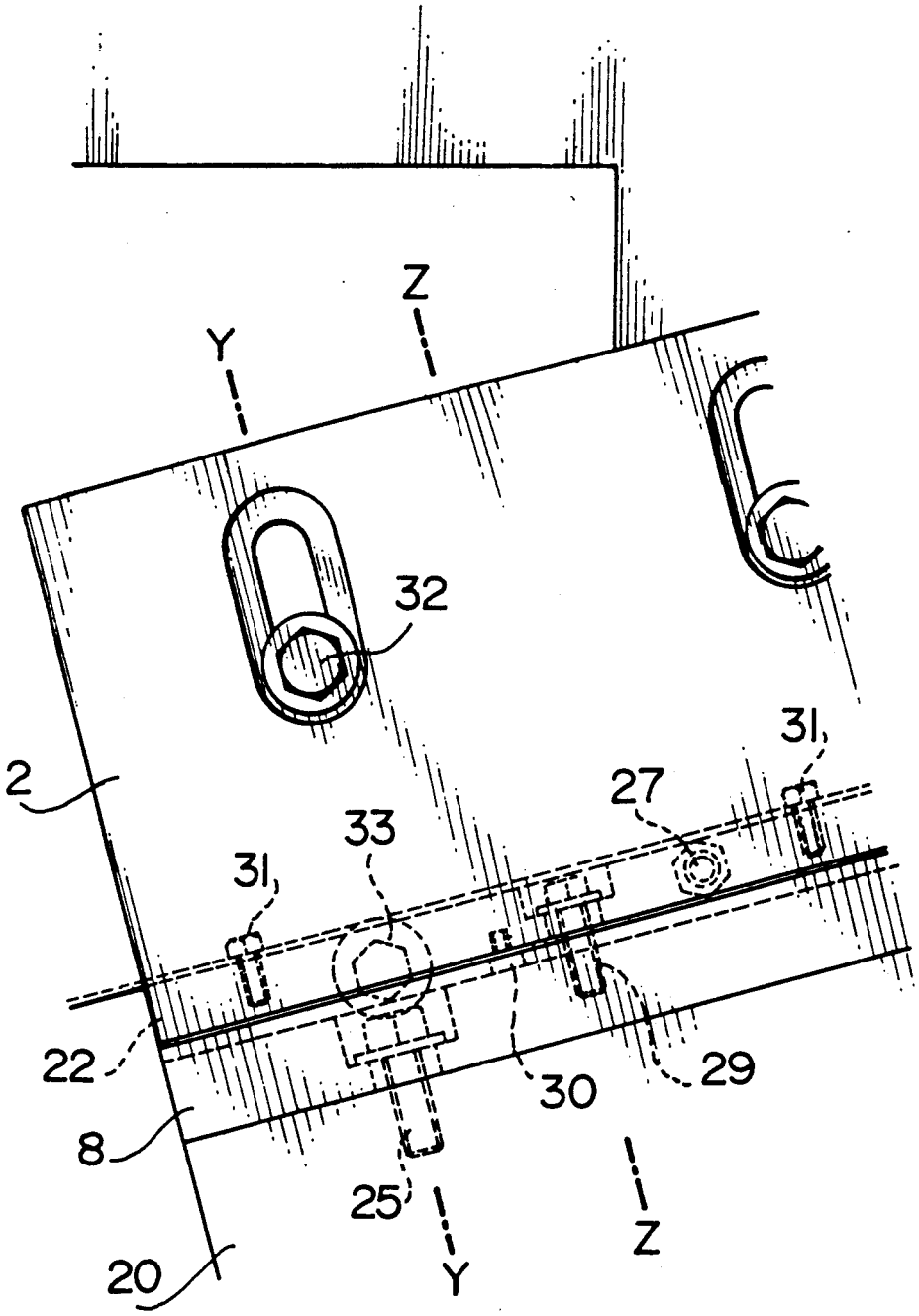
FIG. 4 is a partially enlarged plan view for showing attachment of a knife and a knife piece of FIG. 2.

The support member 22 serves to prevent the veneer 6 to be sliced from being warped. That is, as shown in FIG. 3, when a veneer 6 is sliced by the slicer apparatus 1 according to the present invention, the relief face 2*a* of the knife 2 is opposed to the support member 22 so that the space between the two opposing faces is substantially the same as a thickness of the veneer 6 to be sliced. For which reason, the veneer 6 is prevented, by the relief face 2*a* of the knife 2 and the support member 22, or warped from being separated from the relief face 2*a* of the knife 2. Thus, no cracks appear in the veneer 6, which is guided by the support member 22 and the guide 23 to a feeding direction.

As also shown in FIG. 3, the inclination of the support member 22, where the veneer 6 is sliced, is almost the same as that of the guide 23. This contributes to a smooth feeding of the veneer 6 from the support member 22 to the guide 23, and prevents the veneer 6 from being separated from the relief face 2*a* of the knife 2.

In the knife portion B, the knife 2 is fixed, by fixing means, such as a bolt 32, through an aperture arranged in the knife, to the back table 21.

Therefore, when a thick veneer 6 is sliced by the slicer apparatus for woodwork 1, a large quantity of pressure is applied to the material feeding belt 4 to drive the speed reduction motor 18. When the material 5 is inserted between the material feeding belt 4 and the table rollers 9, the material 5 is pressed not only against the table rollers 9 by the material feeding belt 4, but also against the ruler rollers 10 at the oblique angle to the knife 2. Because of the rolling contact between the material 5 and the table rollers 9 and between the material 5 and the ruler rollers 10, the material 5 encounters less resistance while it is transferred. As a result, the material 5 is reliably advanced at a fixed speed to the knife 2. The veneer 6, whose thickness is adjusted by the space between the knife 2 and the knife piece 8, is thus sliced. At this time, the support member 22 and the guide 23 contact underside of the veneer 6 to be sliced, and guide the veneer 6 backwards, while they deter any warping caused by the fact that the veneer 6 tends to be warped downwards when cutting by the knife 2.

Accordingly, the veneer 6 is prevented from being cracked in its underface by a warp and being twisted. A smooth-faced veneer 6 with no cracks or torsion can thus be produced.

Although not shown in the drawings, a microwave heating apparatus may be installed before the slicer apparatus for woodwork of the present invention. The microwave heating apparatus softens the material by irradiating the material with microwave before it is advanced to the material surface of the slicer apparatus. This makes it easy for the slicer apparatus to slice the material. Other methods of softening the material are boiling and boiling with steam.

When veneers are sliced by the slicer apparatus of this invention, the relief face of the knife is arranged so as to oppose the support member. Since the space between the relief face of the knife and the support member is about the same as the thickness of the veneer to be sliced, the sliced veneer is prevented from being separated or warped from the relief face of the knife. Thus cracks in the veneer can be prevented.

Because of the guide, which is fixed by a fixing means to the support member, a veneer to be sliced is guided in the feeding direction along with the support member and the guide.

Furthermore, the material encounters less resistance while it is moving, because of the table rollers, which are provided on the entire feeding surface except where the knife and the knife piece are disposed, and the ruler rollers, which are arranged on one side of the table rollers. Thus, thick veneers are sliced efficiently.

What is claimed is:

1. A woodwork slicer apparatus for slicing a material, comprising, a table for supporting the material to be sliced and having an opening therein, means for moving the material on the table, said moving means being installed on the table for forcibly transferring the material on the table for slicing, a knife attached to the table to be located at one side of the opening and having an edge and a relief face, a knife piece attached to the table to be located at a side of the opening opposite to the knife, said knife piece being arranged parallel to the knife, and a support member attached to the knife piece and located at a side opposite to the relief face of the knife to form a space between the support member and the relief face of the knife, said space being at least substantially the same as a thickness of a piece of the material sliced by the knife so that the sliced piece does not warp after being sliced by the knife to prevent warp and twist of the sliced piece of the material.

2. A woodwork slicer apparatus according to claim 1, further comprising a guide attached to the support member, said guide smoothly leading the sliced piece of the material beneath the table after passing over the support member.

3. A woodwork slicer apparatus according to claim 1, wherein said table includes table rollers arranged on an upper surface of the table except portions where the knife and knife piece are disposed, and ruler rollers arranged on one side of the table rollers above the table to guide the material to be sliced.

4. A woodwork slicer apparatus according to claim 2, wherein the guide is attached to the support member at an angle substantially the same as an upper surface of the support member.

5. A woodwork slicer apparatus according to claim 2, wherein said space between the support member and the relief face of the knife is gradually widened from the edge of the knife.

6. A woodwork slicer apparatus according to claim 1, wherein said space between the support member and the relief face of the knife is substantially the same as the thickness of the sliced piece of the material throughout the entire space.

7. A woodwork slicer apparatus according to claim 1, wherein said knife piece includes an edge portion formed of a hard material, said edge portion being disposed at a corner facing the knife.

8. A woodwork slicer apparatus according to claim 7, wherein said knife piece includes an adjusting screw attached to the table for adjusting height of the knife piece, and a bolt for fixing the knife piece to the table at a desired height.

9. A woodwork slicer apparatus according to claim 8, wherein said support member includes an adjusting bolt arranged in the support member to adjust height of the support member relative to the table, a bolt for fixing the support member to the knife piece, and an adjusting screw attached to the support member for adjusting the support member horizontally.

10. A woodwork slicer apparatus according to claim 9, wherein said knife includes an adjusting screw attached to the table so that lateral position of the knife can be adjusted on the table.

* * * * *